United States Patent [19]

Isbrandt et al.

[11] 4,423,139

[45] Dec. 27, 1983

[54] STABILIZER COMBINATION FOR DYE OXIDATION

[75] Inventors: Russell R. Isbrandt, White Bear Lake Township, County of Ramsey; Robert D. Lowrey, Aitkin, both of Minn.

[73] Assignee: Minnesota Mining and Manufacturing Company, St. Paul, Minn.

[21] Appl. No.: 352,053

[22] Filed: Feb. 24, 1982

Related U.S. Application Data

[63] Continuation-in-part of Ser. No. 218,558, Dec. 22, 1980, abandoned.

[51] Int. Cl.[3] ..... G03C 1/52

[52] U.S. Cl. ..... 430/338; 430/341; 430/336; 430/340

[58] Field of Search ..... 430/338, 341, 336, 340; 428/913; 106/21

[56] References Cited

U.S. PATENT DOCUMENTS

| | | | |
|---|---|---|---|
| 3,042,515 | 7/1962 | Wainer | 430/332 |
| 3,460,964 | 8/1969 | Dunham | 106/21 |
| 3,974,147 | 8/1976 | Tiers et al. | 260/240 D |
| 3,986,880 | 10/1976 | Wainer et al. | 430/340 |
| 4,066,459 | 1/1978 | Bachman et al. | 430/336 |

FOREIGN PATENT DOCUMENTS

| | | |
|---|---|---|
| 51-941 | 1/1976 | Japan . |
| 51-27544 | 8/1976 | Japan . |
| 51-43786 | 11/1976 | Japan . |
| 52-23806 | 6/1977 | Japan . |
| 52-25330 | 7/1977 | Japan . |

OTHER PUBLICATIONS

L.F.A. Mason "Photographic Processing Chemistry," The Focal Press, London, 15–17, 1966.

Mees and James, "The Theory of the Photographic Process," 3rd ed., pages 283–284 and 390–391.

Kosar, "Light Sensitive Systems," 367 and 370–380, 1965.

*Primary Examiner*—Won H. Louie, Jr.

*Attorney, Agent, or Firm*—Cruzan Alexander; Donald M. Sell; Jennie G. Boeder

[57] ABSTRACT

Synergistic combinations for use in stabilizing thermographic imaging systems comprise (1) one or more aromatic compounds which form quinones, diimines, or quinonimines upon oxidation in combinaton with (2) 1-phenyl-3-pyrazolidinone, or derivatives or 1-phenyl-3-pyrazolidinone. When used in a thermographic in a binder these stabilizing combinations prevent oxidation and premature reaction of the leuco dye.

12 Claims, 2 Drawing Figures

STABILIZER COMBINATION FOR DYE OXIDATION

This application is a continuation-in-part of Applicants'copending application U.S. Ser. No. 218,558, filed Dec. 22, 1980 abandoned.

FIELD OF THE INVENTION

This invention relates to stabilizing thermographic imaging systems by the use of a synergistic combination of (1) one or more aromatic compounds which form quinones, diimines, or quinonimines upon oxidation in combination with (2) 1-phenyl-3-pyrazolidinone, or derivatives of 1-phenyl-3-pyrazolidinone. Thermographic imaging systems which are most suitably stabilized by the stabilizng combinations of this invention comprise a nitrate salt, as an oxidizing ion, and a leuco dye in a binder. The stabilizing combinations stabilize the leuco dye of the thermally developable system against oxidation and premature reaction. In addition, the stabilizing combinations of the present invention do not significantly affect the sensitivity of the thermally imageable film.

BACKGROUND OF THE INVENTION

Ascorbic acid, hindered phenols, phenidone, and 5-hydroxy-2-hydroxymethyl-4-pyrone (known as Kojic acid), have been used with silver films as developers (L. F. A. Mason, Photographic Processing Chemistry, The Focal Press, London, 1966 (pages 15 and 17)). These materials have also been used with leuco dyes in transparency imaging systems to stabilize the leuco dyes against oxidation and premature reaction (commonly assigned copending U.S. Ser. No. 199,444, filed Oct. 22, 1980). Although these materials are useful to stabilize less sensitive leuco dyes which require higher temperatures and longer exposure times to image, they have not been found useful with the more sensitive, faster imaging, leuco dyes, particularly, indolyl substituted triarylmethane dyes, styryl dyes, N-acyl oxazine dyes, N-acyl thiazine dyes, cyanine dyes, N-acyl diazine dyes and xanthene dyes.

SUMMARY OF THE INVENTION

The present invention provides stabilizing combinations which prevent oxidation and premature reaction of leuco dyes, particularly the more sensitive leuco dyes, in thermographic imaging systems. This ability to stabilize is the result of a synergistic effect obtained by the use of a combination of (1) one or more aromatic compounds which form quinones, diimines or quinonimines upon oxidation, or combinations of these, in combination with (2) 1-phenyl-3-pyrazolidinone (commonly known as phenidone), or derivatives of 1-phenyl-3-pyrazolidinone, or combinations of these. The stabilizing combinations of the present invention find use in polymeric binder systems having the necessary active ingredients therein. These ingredients comprise a nitrate salt preferably supplied as a hydrated nitrate salt, at least one leuco dye, and a binder. The active ingredients may also include any materal which supplies hydrogen ion, such as an acidic material. A binder material containing these ingredients and a stabilizing combination of the present invention can be colorized locally by heating portions of the binder layer, or generally colorized by heating the entire layer. The presence of an acidic material accelerates the colorization phenomenon.

BRIEF DESCRIPTION OF THE DRAWINGS

FIGS. 1 and 2 illustrate the synergistic effect of the stabilizing combinations of the present invention.

DETAILED DESCRIPTION OF THE INVENTION

Figure 1:
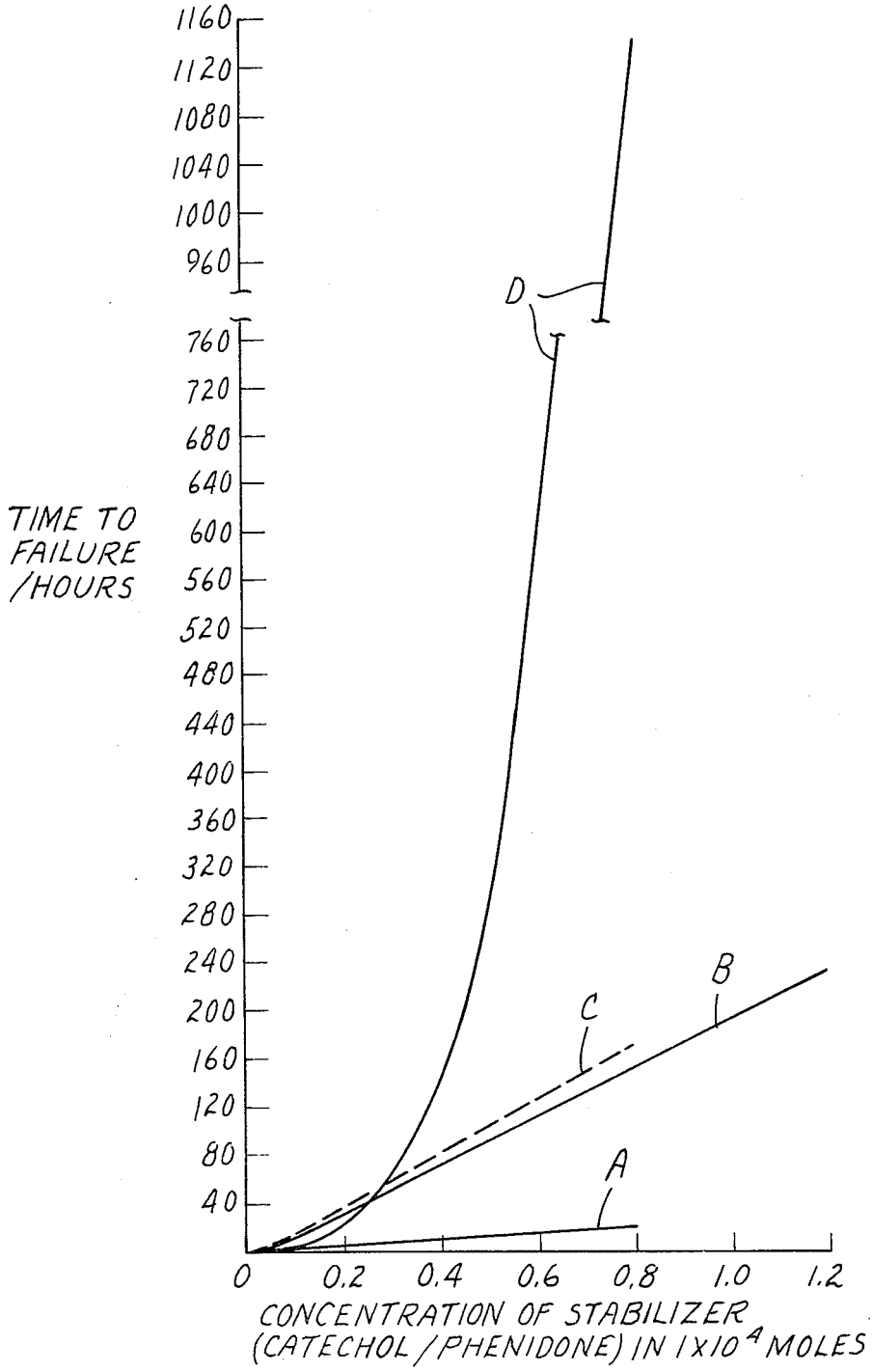
FIGS. 1 and 2 are plots of "Stabilizer Concentration" versus "Time to Failure". Both

There are a minimum of five components to the present invention, and six components to the preferred construction. The five required components are the stabilizing combination comprising (1) one or more aromatic compounds which form quinones, diimines or quinonimines upon oxidation, and (2) 1-phenyl-3-pyrazolidinone, or derivatives of 1-phenyl-3-pyrazolidinone (hereinafter referred to as phenidone and phenidone derivatives, respectively), and combinations of these, the leuco dye, the nitrate salt, and the polymeric binder. The preferred sixth component is a material which supplies hydrogen ions, such as an acidic material.

The Stabilizing Combination

The aromatic component which forms quinones, diimines or quinonimines upon oxidation, has at least two substituents selected from the group consisting of amino and hydroxy substituents. The preferred aromatic groups are benzene and naphthalene rings. At least two of the hydroxy and/or amino substituents on a monocyclic aromatic nucleus must be ortho or para, and there must be at least two hydroxy and/or amino substituents in equivalent positions, (equivalent to ortho and para as hereinafter defined) where the aromatic is a polynuclear aromatic nucleus. Where the aromatic nucleus is naphthalene, the phrase "in equivalent positions" means that the two substituents are in the 1 and 2; 2 and 3; 1 and 4; 1 and 7; or 2 and 6 positions on the naphthalene nucleus. This requirement enables the polyhydroxy aromatic compounds to form quinones upon oxidation, the polyamino aromatic compounds to form diimines upon oxidation, and the aromatic compounds having amino and hydroxy substituents to form quinonimines upon oxidation. In addition it is preferred that these two substituents be coplanar with the aromatic nucleus, i.e., neither substituent is adjacent to a bulky substituent such as tertiary pentyl or higher tertiary alkyl groups, which would force the functional substituent out of the plane of the aromatic nucleus. The aromatic nucleus may be further substituted by groups, such as alkoxy groups having about 1 to 3 carbon atoms, alkyl groups, branched or straight chain, having about 1 to 3 carbon atoms, alkyl substituted amino groups having about 1 to 4 carbon atoms, and ether groups having about 1 to 5 carbon atoms, so long as these substituents do not render the aromatic compound insoluble in the binder. It is preferred that the additional substituents not be strong electron withdrawing groups, such as acyl groups, sulfone groups, sulfonic acid groups, or a plurality of chlorine substituents. An exception to this preference is 4-amino-2,6-dibromophenol.

It is preferred that the above described aromatic compound be substantially in its reduced form, i.e., that no more than 50 percent, preferably no more than 25 percent, and most preferably no more than 10 percent be in an oxidized form in the composition. It is additionally preferred that the oxidation product of the aromatic compound not be itself capable of oxidizing the leuco dye.

Useful aromatic compounds include catechol; hydroquinone; trimethylhydroquinone; 2-t-butylhydroquinone; 2,5-di-t-butylhydroquinone; 3,5-di-isopropylcatechol; 4-(2-aminoethyl)-2-hydroxyphenol.HCl; 1,2,3-trihydroxybenzene; 1,2,4-trihydroxybenzene; 2,3-dihydroxynaphthalene; 1,7-dihydroxynaphthalene; 2,6-dihydroxynaphthalene; o-aminophenol; p-aminophenol; 4-amino-1-naphthol.HCl; 2-amino-4-chlorophenol; 4-amino-3-methylphenol; 4-amino-2,6-dibromophenol; p-phenylenediamine; o-phenylenediamine; 2,3-diaminonaphthalene; and 2,4-diaminophenol.2HCl. Preferred aromatic compounds include catechol; hydroquinone; 2-t-butylhydroquinone; 2,5-di-t-butylhydroquinone; 3,5-di-isopropylcatechol; 4-(2-aminoethyl)-2-hydroxyphenol.HCl; 1,2,3-trihydroxybenzene; 1,2,4-trihydroxybenzene; o-aminophenol; p-aminophenol; 4-amino-3-methylphenol; 4-amino-2,6-dibromophenol; 2,3-diaminonaphthalene; and 1,7-dihydroxynaphthalene. Particularly preferred aromatic compounds include catechol, hydroquinone; 2-t-butylhydroquinone; 1,2,3-trihydroxybenzene; 1,2,4-trihydroxybenzene; and p-aminophenol.

The phenidone or phenidone derivative component of the synergistic combination has the general formula:

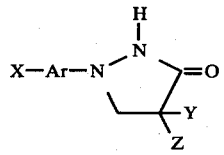

wherein

Ar is a phenyl or naphthyl group;

X is an aryl group, an alkyl or alkoxy group, branched or straight chain, having about 1 to 5 carbon atoms, H, F, Cl, Br or I; and Y and Z are independently H or an alkyl group, branched or straight chain, having about 1 to 5 carbon atoms.

Additionally, the aromatic group and the heterocyclic group may be further substituted by alkyl groups, straight or branched chain, having from about 1 to 5 carbon atoms. Preferably Ar is phenyl; Y is H; Z is H; and X is H, F, Cl, Br, an aryl group, or an alkyl or alkoxy group having about 1 to 5 carbon atoms. Where the component is phenidone Ar is phenyl, X is H, Y is H and Z is H.

It is preferred that the phenidone or phenidone derivative component be substantially in its reduced form, i.e., that no more than 50 percent, preferably no more than 25 percent, and most preferably no more than 10 percent be in an oxidized form.

To be useful the stabilizing combinations of the present invention should permit the thermally imageable layer, when heated to about 80° C. for 30 seconds, to form an image having an optical density ($D_{max}$) of at least about 0.5, preferably at least 0.8, and most preferably at least 1.0. However, with mechanical viewing of the image or heating to a higher temperature, a lower optical density is useful. Additionally, the unimaged background area must have an optical density ($D_{min}$) of no more than 0.50, preferably no more than 0.30, more preferably no more than 0.10, and most preferably no more than 0.03. The colored image area should not decrease in optical density more than 0.3, preferably no more than 0.2, and most preferably no more than 0.1, after about 90 minutes on the stage of an overhead projector. Additionally, the ratio $D_{max}/D_{min}$ should not be less than 2, preferably not less than 10, and most preferably not less than 30 after 90 minutes on the stage of an overhead projector.

It is preferred that the ratio of phenidone or phenidone derivative to aromatic compound which forms quinones, diimines or quinonimines upon oxidation, be between about 0.7:1.0 and 3:1. More preferably the ratio is between about 1:1 and 2:1.

The maximum amount of stabilizing combination in the imageable layer is theoretically limited only by the solubility of the stabilizing combination in the polymeric binder. Preferably, however, the concentration of the stabilizing combination is between about 0.08 and 2.0 moles per mole of dye, and more preferably between about 0.4 and 1.4 moles per mole of dye. The optimum amount of the stabilizing combination in the imageable layer is a function of the amount of leuco dye, nitrate salt, and acid present. The optimum concentration of the stabilizing combination increases with increased concentrations of nitrate salt and increased concentrations of acid.

The stabilizing ability of the combination of the present invention is surprising in view of the fact that many closely related phenolic compounds do not provide the same stabilizing effect to thermographic leuco dye imaging systems. For example the use of phenol; 1,3,5-trihydroxybenzene; or 2,7-dihydroxynaphthalene have no stabilizing effect. When used in thermally imageable leuco dye systems these compounds produce imaged films having background densities which are one-half as dense, and often as dense, as the image densities.

Similarly, phenolic compounds such as resorcinol; butylated hydroxy toluene; and 1,8-dihydroxynaphthalene when included in leuco dye thermographic imaging systems have no stabilizing effect on the system. The films image upon oven drying the coating on the film, at no more than about 47° C.

The Binder

Almost any polymeric binder may be used in the practice of the present invention. The resin may be weakly basic, neutral or acidic. The acidity of the resin has been found to affect only the speed of the colorizing effect. Organic polymeric resins, preferably thermoplastic, although thermoset resins may be used, are generally preferred. Where speed is more important, either the more acidic resins should be used or an acid should be added to the system to increase the rate of colorizing. Such resins as polyvinyl acetals, polyester, polyvinyl resins, polyvinylpyrrolidone, polyesters, polycarbonates, polyamides, polyacrylates, cellulose esters, copolymers and blends of these classes of resins, and others have been used with particular success. Natural polymeric materials such as gelatin and gum arabic may also be used. Where the proportions and activities of dyes and nitrate salt require a particular developing time and temperature, the resin should be able to withstand those conditions. Generally it is preferred that the polymer not decompose or lose its structural integrity at 200° F. (93° C.) for 30 seconds, and most preferred that it not decompose or lose its structural integrity at 260° F. (127° C.) for 30 seconds.

Beyond these minimal requirements, there is no criticality in the selection of a binder. In fact, even transparency and translucency are not required, although they are desirable. Where, for example, the polymer is itself an opaque white, the thermally treated area will become colored and the nontreated areas will remain white.

The binder normally maintains the other components of the coating in solution. Additionally, the binder may serve a number of other important purposes in the constructions of the present invention, i.e., it may protect the imageable materials from environmental conditions such as moisture.

The Nitrate Salt

Nitrate salts are themselves well known. They may be supplied as various chemical compounds, but are desirably provided as metal salts, and most preferably as hydrated metal salts. Other ions which are ordinarily good oxidizing ions such as nitrite, chlorate, iodate, perchlorate, periodate, and persulfate do not provide comparable results. Extremely active oxidizing agents, such as iodate, even used in relatively smaller proportions to prevent complete and immediate oxidation or colorization of dyes do not perform nearly as well as nitrate ion compositions. The performance of nitrate is so far superior to any other ion that it is apparently unique in the practice of the present invention. While some of the better oxidizing ions other than nitrate produce a maximum density ($D_{max}$) in the image of about 0.90 and a minimum density ($D_{min}$) of 0.25 in their best construction, the better constructions with nitrate ions can have a $D_{max}$ in excess of 1.0 and a $D_{min}$ below 0.10.

Most means of supplying the nitrate salt into the composition are satisfactory, e.g., organic salts, metal salts, acidic salts, mixtures of acids and salts, and other means of supplying the ion are useful. For example, nitrates of zinc, cadmium, calcium, zirconyl ($ZrO^{+2}$), nickel, aluminum, chromium, iron (III), copper (II), magnesium, lead, cobalt, beryllium, cerous, lanthanum, manganous, mercurous, uranyl, and thorium, ammonium nitrate, and cerous ammonium nitrate have been used.

The nitrate salt component of the present invention must be present in a form within the imaging layer so that oxidizing quantities of $HNO_3$, or oxides of nitrogen, e.g., $NO_2$, and $N_2O_4$, will be provided within the layer when it is heated to a temperature no greater than 200° C. for 60 seconds and preferably at much lower temperatures and shorter times. This may be accomplished with many different types of salts, both organic and inorganic, and in various different types of constructions.

The most convenient way of providing such nitrate salts is to provide a hydrated nitrate salt such as aluminum nitrate nonahydrate ($Al(NO_3)_3.9H_2O$). This salt, when heated in a binder, will generate $HNO_3$, and/or oxides of nitrogen in various amounts. The binder should not be so alkaline that the liberated nitric acid would be immediately neutralized, as this would adversely affect the oxidizing capability of the system. It is not essential that a completely acidic or neutral environment be provided, but even a mildly alkaline environment may in many cases completely prevent oxidation. It is therefore desired that the nitrate salt be neutral, and more preferably acidic.

In addition to hydrated nitrate salts, nonhydrated salts in layers which are neutral and preferably in an acidic environment are also capable of providing $HNO_3$ and/or oxides of nitrogen in sufficient quantities to provide the oxidizing capability necessary for practice of the present invention. Ammonium nitrate, for example, does not enable good oxidation in the present invention in a layer which is even mildly alkaline, but when a moderate strength organic acid such as phthalic acid is added, a quite acceptable imaging system is provided.

Beside the inorganic types of salts generally described above, organic salts in nonalkaline environments are also quite useful in the practice of the present invention. In particular, amine salts such as guanidinium nitrate work quite well in acid environments, but will not provide any useful image in alkaline environments.

It is believed that the alkaline environment causes any oxidizing agent (e.g., $HNO_3$ and oxides of nitrogen) which is liberated from the nitrate salt to be preferentially reacted with hydroxy ions or other neutralizing moieties so as to prevent oxidation of the dyes. For this reason it is preferred to have the environment of the nitrate salt be neutral and more preferably, slightly acidic.

One other consideration should be given in the selection of the nitrate salt and that is the choice of a salt in which the cation is nonreactive with the dye. Nonreactive salts are defined in the practice of the present invention as those salts the cations of which do not spontaneously oxidize the dyes that they are associated with at room temperature. This may be readily determined in a number of fashions. For example, the dye and a nonnitrate, preferably halide, salt of the cation may be codissolved in a solution. If the salt oxidizes the dye spontaneously (within two minutes) at room temperature, it is a reactive salt. Such salts as silver trifluoromethyl sulfonate, in which the cation is itself a strong oxidizing agent, is a reactive salt. Ceric trifluoromethyl sulfonate is also reactive, while hydrated cerous trifluoromethyl sulfonate is not.

Preferred salts are the hydrated metal salts such as nickel nitrate hexahydrate, magnesium nitrate hexahydrate, aluminum nitrate nonahydrate, ferric nitrate nonahydrate, cupric nitrate trihydrate, zinc nitrate hexahydrate, cadmium nitrate tetrahydrate, bismuth nitrate pentahydrate, thorium nitrate tetrahydrate, cobalt nitrate hexahydrate, gadolinium or lanthanum nitrate nonahydrate, mixtures of these hydrated nitrates and the like. Nonhydrated or organic nitrates may be admixed therewith.

Orgaic nitrates are also quite useful in the practice of the present invention. These nitrates are usually in the form of guanidinium nitrate, pyridinium nitrate, and the like. Nitrate salts of dyes will also be useful, but again, they must be used in an environment which will not neutralize any liberated $HNO_3$ and/or oxides of nitrogen.

It is preferred to have at least 0.02 moles of nitrate ion per mole of dye. It is more preferred to have at least 1.0 mole of ion per mole of dye, and it is most preferred to have 2–5 moles of ion per mole of dye. However, even amounts up to 100 moles of nitrate ion per mole of dye have been found useful. Since certain dyes are subject to destruction by the decomposition products produced by the oxidation of the nitrate ion, it is necessary to adjust the nitrate ion ratio so as not to be excessive enough to cause substantial destruction.

Leuco Dyes

Leuco dyes are colorless dyes which when subjected to an oxidation reaction form a colored dye. These leuco dyes are well known in the art (e.g., *The Theory of the Photographic Process,* 3rd *Ed.,* Mees and James, pp. 283-4, 390-1, McMillan Co., N.Y.; and *Light-Sensitive Systems,* Kosar, pp. 367, 370–380, 406 (1965) Wiley and Sons, Inc., N.Y.) and U.S. Pat. No. 3,974,147. Preferred leuco dyes, for use in the practice of the present invention are the more sensitive, fast imaging leuco dyes including indolyl substituted triarylmethane dyes, styryl dyes, N-acyl oxazine dyes, N-acyl thiazine dyes, cyanine dyes, N-acyl diazine dyes and xanthene dyes. Particularly preferred leuco dyes include indolyl substituted triarylmethane dyes, N-acyl thiazine, and styryl dyes. Before the present invention, stability on the stage of an overhead projector was the major performance failing of these dyes.

As discussed hereinabove, leuco dyes which are converted to colored dyes by oxidation are useful in the practice of the present invention. Acid or base sensitive dyes such as phenolphthalein are not useful in the present invention unless they are also oxidizable to a colored state. Indicator dyes would only form transient images or would be too sensitive to changes in the environment.

The leuco dye should be present as at least 0.5% by weight of the binder, preferably as at least 1% by weight of the binder, and most preferably as from 2 to 10% or more by weight of the binder.

The proportions of nitrate salt and leuco dye should be such that on heating the layer to about 80° C. for 30 seconds there is at least an optical density of 0.5 obtained, although with a mechanical viewing of the image or heating to a higher temperature, a lower optical density is useful. Depending upon the relative ease of colorizing the particular dyes selected, the relative proportion of nitrate ion to dye may vary. As a general rule, at least 0.02 mole of nitrate ion per mole of dye is desirable in the practice of the present invention. At least 1.0 mole of nitrate per mole of dye is more preferred, and at least 2 to 5 moles of nitrate per mole of dye is most preferred.

The acids optionally useful in the present invention are acids as generally known to the skilled chemist. Organic acids are preferred, but inorganic acids (generally in relatively smaller concentrations) are also useful. Organic acids having carboxylic groups are more preferred. The acid may be present in a molar concentration of from 0 to 10 times that of the nitrate ion. More preferably it is present in molar concentration of from 0.2 to 2.0 times that of the nitrate ion.

The imaging compositions of the present invention may contain various materials in combination with the essential ingredients. For example, lubricants, coating aids, antioxidants (e.g., ascorbic acid, hindered phenols, etc. in amounts that would not prevent oxidation of the dyes when heated), surfactants, antistatic agents, mild oxidizing agents in addition to the nitrate, and brighteners may be used without adversely affecting the practice of the invention.

In forming the imageable layer, or coating the layer onto a substrate, temperatures should, of course, not be used during manufacture which would completely colorize the layer. Some colorization may be tolerable, but this depends upon the particular end use of the product. It is preferred, however, that little or no dye be colorized during forming or coating so that a more uniformly colorizable layer can be formed. Depending on the anticipated development temperature, the coating or forming temperature can be varied. Therefore, if the anticipated development temperature were, for example, 100° C. the drying temperature could be 65° C. or less provided the dwell time was greater than about one minute. A reasonable development temperature range is between 75° C. and 100° C. and a reasonable dwell time is between 0.15 and 0.5 seconds, preferably at between 80° C. and 90° C. and for 0.2 to 0.3 seconds, with the longer times most likely associated with the lower development temperatures.

The imaging layers of the present invention must allow reactive association of the active ingredients in order to enable imaging. That is, the individual ingredients may not be separated by impenetrable barriers within the layer, as with dispersed immiscible phases. Generally, the active ingredients are homogeneously mixed (e.g., a molecular mixture of ingredients) within the layer. They may be individually maintained in heat softenable binders which are dispersed or mixed within the layer and which soften upon heating to allow migration of ingredients, but this would require a longer development time.

All of this will be more thoroughly understood by consideration of the following examples:

EXAMPLE 1

The following coating solutions were prepared.

(I)
- Aluminum nitrate nonahydrate—0.05 gm
- 1-(1,3,3-trimethyl-2-indolyl)-2-(p-morpholinylphenyl)ethene—0.03 gm
- Phthalic acid—0.05 gm
- Benzotriazole—0.05 gm
- Phenidone—0.005 gm
- Ethanol—4.90 gm
- Methyl alcohol—0.50 gm
- Cellulose acetate butyrate available under the trade name "CAB 171-15S" from Eastman Kodak, as a 15% by weight solution in acetone/methylisobutyl ketone, 85:15 percent by weight respectively.—10.00 gm (II) Identical to solution I except that 0.12 gm of 5 percent by weight catechol in ethanol was added.

(III) Identical to solution I except that 0.25 gm of 5 percent by weight catechol in ethanol was added.

The above three coating solutions were coated on polyvinylidene chloride primed polyester film, 100 microns thick, at 75 microns wet thickness. After drying at 43° C. in a forced air oven for about 10 minutes each film was imaged on a Model 45 infrared transparency maker, available from 3M Co. The imaging speed, i.e., the rate at which the film passes under a 1350 watt infra red lamp in the transparency maker, was about 6.1 cm/sec. The image densities for each coated film were measured using a MacBeth Model TD-404-A densitometer with a green standard densitometer filter, and are reported below. The projector used was a Model 66 overhead projector available from 3M Co. with the glare shield removed.

| | Coating Solutions | | |
|---|---|---|---|
| | I | II | III |
| $D_{max}$[1] immediately after imaging | 0.77 | 0.77 | 0.77 |
| $D_{min}$[2] immediately after imaging | 0.06 | 0.06 | 0.06 |

-continued

| | Coating Solutions | | |
|---|---|---|---|
| | I | II | III |
| $D_{max}$ after 2½ hours on the stage of the projector | 0.44 | 0.49 | 0.64 |
| $D_{min}$ after 2½ hours on the stage of the projector | 0.14 | 0.09 | 0.09 |

[1]$D_{max}$ is the density of the imaged area of the film.
[2]$D_{min}$ is the density of the non-imaged area or the background of the film.

This example illustrates that the stabilizing combination of catechol and phenidone, helps maintain the background density and the image density of the coated films when they are left on the stage of the projector.

The sensitivities of the above solutions were measured using the CATS, Cam Actuated Thermo Sensitometry, test. The CATS test was performed according to the following procedure. Each coating solution was coated on polyvinylidene chloride primed polyester film, 100 microns thick, at 75 microns wet thickness and dried at 43° C. in a forced air oven for 8 minutes. The film was 20.32 cm long and 5.08 cm wide. A white piece of paper, 20.32 cm long and 5.08 cm wide, printed with black lines running parallel to the width, which are 0.5 mm in width and 0.5 mm apart, was superimposed over the coated side of the film. This construction was placed lengthwise on a platen with the uncoated side of the film up. The platen was equipped with a source to heat the film to 40° C. and with a vacuum which pumps the air from between the film and the platen and holds the film and the paper flat on the platen. A 1350 watt infrared linear filament lamp equipped with an elliptical linear reflector was stationed at one end of the platen parallel to the width of the film and 2.54 cm from the surface of the platen. A cam drive then moves the platen carrying the film and paper at a linearly accelerating rate under the infrared lamp. The platen accelerates smoothly and the film exposure is logarithmic along the length of the film. Dwell time at the beginning of the exposure is less than about 1.0 second and at the end of the film, the exposure is less than about 0.1 second.

The length of the film which visually images is a measure of the sensitivity of the dye. The part of the film which receives the least exposure, i.e., the least heat, does not image. Measurements are made along the strip of imaged film. A zero point is defined to be 15.24 cm (6 in.) from the end of the film which had the longest exposure time. At this zero point the film will transmit practically all incident light, i.e. there will be no visible image. The light transmission is measured at this point with the MacBeth densitometer using the filter most appropriate for the image color. The point along the imaged film is found where the reading is 0.30 above that at the zero point. The distance between these readings is measured. A large distance, i.e., greater than about 100 mm, results when there is a relatively long unimaged area and indicates that the dye has relatively low sensitivity. A short distance, i.e., less than about 100 mm results when the unimaged area is relatively short and indicates that the dye has relatively greater sensitivity. Preferably the CATS sensitivity of the film should be 130 mm or less, and more preferably the CATS sensitivity should be 100 mm or less.

The CATS sensitivities for films coated with solutions I, II or III are reported below.

| | Coating Solution | | |
|---|---|---|---|
| | I | II | III |
| CATS | 84 mm | 95 mm | 97 mm |

Thus, the addition of the stabilizing combination of catechol and phenidone does not seriously reduce the sensitivity of the thermally imageable films.

EXAMPLE 2

The following coating solutions were prepared.

(I)
Aluminum nitrate nonahydrate—0.075 gm
Ethanol—3.00 gm
β-Resorcylic acid—0.046 gm
Phenidone—0.005 gm
1-(1,3,3-trimethyl-2-indolyl)-2-(p-morpholinyl-phenyl)ethene—0.040 gm
Cellulose acetate butyrate, available under the trade name "CAB 171-25" from Eastman Kodak (as a 15% by weight solution in acetone/methylisobutyl ketone, 85:15 percent by weight respectively)—10.000 gm (II) Identical to solution I except that 0.0034 gms of catechol as a 0.68% by weight solution in ethanol were added.

(III) Identical to solution I except that 0.0068 gms of catechol as a 0.68% by weight solution in ethanol were added.

The above three solutions were coated on film, dried, and imaged, as in Example 1. The densities of the imaged areas of the films ($D_{max}$) and the unimaged background areas of the films ($D_{min}$) were measured as in Example 1, immediately after imaging. The results are reported below.

| | Coating Solution | | |
|---|---|---|---|
| | I | II | III |
| $D_{max}$ | 1.80 | 1.20 | 1.29 |
| $D_{min}$ | 0.78 | 0.66 | 0.08 |

This example illustrates that the stabilizing combination of catechol and phenidone, decreases thermal development of the film in the unimaged areas without destroying the thermal sensitivity in the imaged areas.

EXAMPLE 3

The following coating solutions were prepared.

| | Coating Solution | | |
|---|---|---|---|
| | I(gm) | II(gm) | III(gm) |
| Nickel Nitrate | .0436 | .0436 | .0436 |
| Ethanol | — | 1.0000 | 1.0000 |
| Methyl Isobutyl Ketone | 1.4899 | .5000 | .5000 |
| Tetrahydrofuran | .6651 | .6651 | .6651 |
| Phthalic Acid | .0375 | .0375 | .0375 |
| Phenidone | .0038 | .0038 | .0038 |
| Dye[1] | .0590 | .0590 | .0590 |
| Cellulose acetate butyrate 15% Solution, as in Example 1 | 20.0000 | 20.0000 | 20.0000 |
| Catechol[2] | .0101 | — | — |
| Kojic Acid[3] | — | .0590 | — |
| Ascorbic Acid[4] | — | — | .0506 |
| Phenol substituted benzotriazole available under the trade name "Tinuvin P" | .1000 | .1000 | .1000 |

-continued

| | Coating Solution | | |
|---|---|---|---|
| | I(gm) | II(gm) | III(gm) |
| from Ciba-Giegy | | | |

[1]The dye is 1(1 Phenyl-3,3-dimethyl-2-indolyl)-2-(p-N,N—di-ethylaminophenyl)ethene
[2]This amount of catechol is equal to 0.093 mmoles, or 0.61 mmole of catechol per mmole of dye
[3]This amount of Kojic Acid is equal to 0.415 mmoles, or 2.77 mmole of Kojic Acid per mmole of dye
[4]This amount of ascorbic acid is equal to 0.32 mmoles or 2.13 mmoles of ascorbic acid per mmole of dye.

Each coating solution was coated on polyvinylidene chloride primed polyester, 100 microns thick, at 125 microns wet thickness and dried in a forced air oven at about 43° C. for 10 minutes. The films were imaged as in Example 1. The image densities were measured as in Example 1, and are recorded hereinbelow.

| Coating Solution | Additive | Initial $D_{max}$ | Initial $D_{min}$ | After 6 hours on Overhead Projector* $D_{max}$ | After 6 hours on Overhead Projector* $D_{min}$ |
|---|---|---|---|---|---|
| I | Catechol | 1.38 | .03 | 1.54 | .07 |
| II | Kojic Acid | Backgrounded in Oven | | | |
| III | Ascorbic Acid | Backgrounded in Oven | | | |

*The overhead projector was that of Example 1

This example illustrates the inefficacy of Kojic acid or ascorbic acid in combination with phenidone as stabilizing combinations.

EXAMPLE 4

The following coating solution was prepared.
Nickel Nitrate—0.0436 gm
Tetrahydrofuran—0.6651 gm
Ethanol—1.9807 gm
Phthalic Acid—0.0375 gm
Phenidone—0.0038 gm
Dye (same as example 3)—0.0590 gm
Cellulose acetate butyrate, of example 1, as a 10 percent by weight solution in acetone/methyl isobutyl ketone, 90:10 percent by weight, respectively—20.0000 gm
2,3-Diaminonaphthalene—0.0193 gm The coating solution was coated on film, dried and imaged as in Example 1. The densities of the imaged and background areas were measured, as in Example 1, both immediately after imaging and after 90 minutes on the stage of the projector.

| Initial $D_{max}$ | Initial $D_{min}$ | After 90 min on Projector* $D_{max}$ | After 90 min on Projector* $D_{min}$ |
|---|---|---|---|
| 1.48 | 0.05 | 1.53 | 0.07 |

*The overhead projector was that of Example 1.

This example illustrates the efficacy of the combination of 2,3-diaminonaphthalene with phenidone as a stabilizer to maintain the background and image densities of a film of the present invention when left on the stage of a projector.

EXAMPLE 5

A coating solution was prepared according to Example 4, except that the 2,3-diaminonaphthalene and ethanol were replaced by 1.5 gms of a stock solution of 0.17 gm of hydroquinone in 25 gms of ethanol. The coating solution was coated on film, dried and imaged as in Example 1. The densities of the imaged and background areas were measured as in Example 1, both immediately after imaging and after 90 minutes on the stage of the projector described in Example 1.

| Initial $D_{max}$ | Initial $D_{min}$ | After 90 min. on Projector $D_{max}$ | After 90 min. on Projector $D_{min}$ |
|---|---|---|---|
| 1.51 | 0.03 | 1.58 | 0.19 |

This example illustrates the efficacy of the combination of hydroquinone with phenidone as a stabilizer to maintain the background and image densities of the film when left on the stage of a projector.

EXAMPLE 6

A coating solution was prepared according to Example 4, except that the 2,3-diaminonaphthalene and ethanol were replaced with 1.50 gm of a stock solution of 0.257 gm of 2-t-butylhydroquinone in 25 gm of ethanol. The coating solution was coated on film, dried and imaged as in Example 1. The densities of the imaged and background areas were measured as in Example 1, both immediately after imaging and after 90 minutes on the stage of the projector described in Example 1.

| Initial $D_{max}$ | Initial $D_{min}$ | After 90 min. on Projector $D_{max}$ | After 90 min. on Projector $D_{min}$ |
|---|---|---|---|
| 1.57 | 0.04 | 1.53 | 0.27 |

This example illustrates the efficacy of the combination of 2-t-butylhydroquinone and phenidone as a stabilizer to maintain the background and image densities of the film when left on the stage of a projector.

EXAMPLE 7

A coating solution was prepared according to Example 4, except that the 2,3-diaminonaphthalene and ethanol were replaced by 1.50 gm of a stock solution of 0.195 gm of 1,2,3-trihydroxybenzene in 25 gm of ethanol. The coating solution was coated on film, dried and imaged as in Example 1. The densities of the imaged and background areas were measured as in Example 1, both immediately after imaging and after 90 minutes on the stage of the projector described in Example 1.

| Initial $D_{max}$ | Initial $D_{min}$ | After 90 min. on Projector $D_{max}$ | After 90 min. on Projector $D_{min}$ |
|---|---|---|---|
| 1.27 | 0.03 | 1.37 | 0.08 |

This example illustrates the efficacy of the combination of 1,2,3-trihydroxybenzene and phenidone as a stabilizer to maintain the background and image densities of the film when left on the stage of a projector.

EXAMPLE 8

A coating solution was prepared according to Example 4, except that the 2,3-diaminonaphthalene and ethanol were replaced with 2.50 gm of a stock solution of 0.195 gm of 1,2,4-trihydroxybenzene in 25 gm of ethanol. The coating solution was coated on film, dried and imaged as in Example 1. The densities of the imaged and background areas were measured as in Example 1, both immediately after imaging and after 90 minutes on the stage of the projector described in Example 1.

| Initial | | After 90 min. on Projector | |
|---|---|---|---|
| $D_{max}$ | $D_{min}$ | $D_{max}$ | $D_{min}$ |
| 1.62 | 0.04 | 1.61 | 0.26 |

This example illustrates the efficacy of the combination of 1,2,4-trihydroxybenzene and phenidone as a stabilizer to maintain the background and image densities of the film when left on the stage of a projector.

EXAMPLE 9

A coating solution was prepared according to Example 4, except that the 2,3-diaminonaphthalene and ethanol were replaced by 1.50 gm of a stock solution of 0.168 gm of p-aminophenol in 25 gm of ethanol. The coating solution was coated on film, dried and imaged as in Example 1. The densities of the imaged and background areas were measured as in Example 1, both immediately after imaging and after 90 minutes on the stage of the projector described in Example 1.

| Initial | | After 90 min. on Projector | |
|---|---|---|---|
| $D_{max}$ | $D_{min}$ | $D_{max}$ | $D_{min}$ |
| 1.69 | 0.05 | 1.65 | 0.59 |

This example illustrates the efficacy of the combination of p-aminophenol and phenidone as a stabilizer to maintain the background and image densities of the film when left on the stage of a projector.

EXAMPLE 10

Fourteen coating solutions were prepared using 0.058 grams of the reduced and benzoylated form of N,N-diethylphenosafranine[1], 0.050 grams of the reduced and benzoylated form of Safranine O[2], 0.023 grams of 3,7-bis(-diethylamino)-10-benzoylphenoxazine[3] (commercially available as "Pergascript Turquoise S-2G" from the Ciba-Geigy Co.), 4.0 grams tetrahydrofuran (THF), 0.06 grams phthalic acid, 0.12 grams nickel nitrate dihydrate, 8.0 grams of a solution of 15 percent by weight vinylidene chloride copolymerized with acrylonitrile (commercially available as "Saran F-310" from Dow Chemicals Co.) in a solution of 90 percent by weight acetone and 10 percent by weight THF, and varying amounts of phenidone, and catechol, as follows:

[1]This dye has the formula

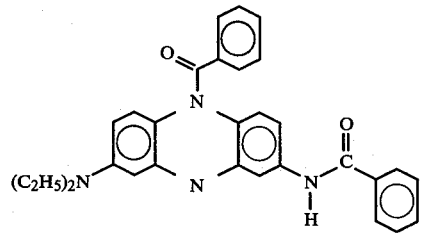

[2]This dye has the formula

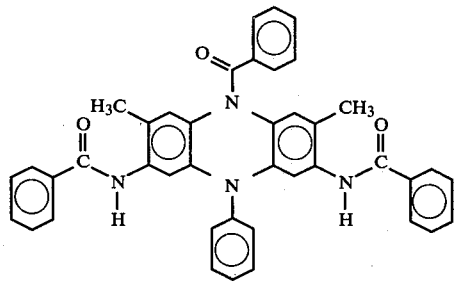

[3]This dye has the formula

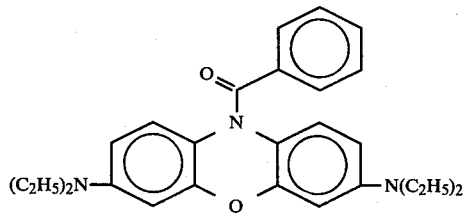

| Coating Solution No. | Moles Catechol | Moles Phenidone | Approximate Time To Failure (in hours) |
|---|---|---|---|
| 1 | 0.0 | 0.0 | <20 |
| 2 | 0.0 | $0.2 \times 10^{-4}$ | <20 |
| 3 | 0.0 | $0.4 \times 10^{-4}$ | <20 |
| 4 | 0.0 | $0.6 \times 10^{-4}$ | <20 |
| 5 | 0.0 | $0.8 \times 10^{-4}$ | <20 |
| 6 | $0.2 \times 10^{-4}$ | 0.0 | 20 |
| 7 | $0.4 \times 10^{-4}$ | 0.0 | 67 |
| 8 | $0.6 \times 10^{-4}$ | 0.0 | 140 |
| 9 | $0.8 \times 10^{-4}$ | 0.0 | 160 |
| 10 | $1.2 \times 10^{-4}$ | 0.0 | 220 |
| 11 | $0.2 \times 10^{-4}$ | $0.2 \times 10^{-4}$ | 20 |
| 12 | $0.4 \times 10^{-4}$ | $0.4 \times 10^{-4}$ | 140 |
| 13 | $0.6 \times 10^{-4}$ | $0.6 \times 10^{-4}$ | 552 |
| 14 | $0.8 \times 10^{-4}$ | $0.8 \times 10^{-4}$ | >1,140 |

Each of the above fourteen coating solutions were coated on clear polyester film, 100 microns thick, at 75 microns wet thickness. After drying at 49° C. in a forced air oven for about five minute, each film was stored overnight in a dark room at room temperature. The next day the films wer separated using paper slip sheets, placed in a manila folder, and put in an oven set at 49° C. and 10 percent relative humidity until failure. For purposes of this example, failure is defined as the time at which the coated film has a density of about 0.09 density units using a MacBeth Model TD 504-A densitometer equipped with green, blue, red and yellow standard densitometer filters, or when the film becomes visibly spotted. The results are reported above.

Concentration of stabilizer, i.e., catechol or phenidone, versus time to failure is plotted in FIG. 1. Curve A represents those coating solutions containing no catechol (Coating Solutions 1–5). Although it is not known exactly when films carrying Coating Solutions 1–5 failed, it is known that they had failed before 20 hours in the oven. Curve B represents coating solutions containing only catechol with no phenidone (Coating Solutions 6–9). Curve C represents the curve resulting from the addition of curves A and B. If the effects of catechol and phenidone were merely additive, Curve C would be the expected result of coating solutions containing both catechol and phenidone. Curve D illustrates the effect of combinations of catechol and phenidone (Coating Solutions 10–13) upon time of failure. One can readily see from an examination of FIG. 1 that the stabilizing effect of combinations of catechol and phenidone is synergistic.

EXAMPLE 11

Six coating compositions were prepared using 0.12 grams nickel nitrate dihydrate, 0.106 grams 1-(5-chloro-1,3,3-trimethylindol-2-yl)-2-(3-bromo-4-N,N-dimethylaminophenyl)ethene, 0.06 grams phthalic acid, 4.0 grams THF and 8.0 grams of a 15 percent by weight solution of vinylidene chloride copolymerized with acrylonitrile ("Saran F-310") in methylethyl ketone, and varying amounts of phenidone, 2,3-diaminonaphthalene, and o-aminophenol, as follows:

| Coating Solution No. | Moles of 2,3-Diaminonaphthalene[1] | Moles of Phenidone[2] | Moles of o-aminophenol[3] |
|---|---|---|---|
| 1 | 0.0 | 0.0 | 0.0 |
| 2 | $0.8 \times 10^{-4}$ | 0.0 | 0.0 |
| 3 | 0.0 | 0.0 | $0.8 \times 10^{-4}$ |
| 4 | 0.0 | $0.8 \times 10^{-4}$ | 0.0 |
| 5 | $0.4 \times 10^{-4}$ | $0.4 \times 10^{-4}$ | 0.0 |
| 6 | 0.0 | $0.4 \times 10^{-4}$ | $0.4 \times 10^{-4}$ |

[1]The 2,3-diaminonaphthalene was provided as a stock solution comprising 0.316 grams (2.0 mmole) of 2,3-diaminonaphthalene in 19.684 grams of THF.
[2]The phenidone was provided as a stock solution comprising 0.32 grams of phenidone in 19.676 grams of THF.
[3]The o-aminophenol was provided as a stock solution comprising 0.218 grams (2.0 mmole) of o-aminophenol in 19.782 grams of THF.

Each of the above coating solutions was coated at 75 microns wet thickness on clear polyester film, dried at 49° C. in a forced air oven for about five minutes, and stored overnight in a dark room at room temperature. The coated films were separated using paper slip sheets, placed in a manila folder, and then placed in an oven maintained at a temperature of 49° C. and a relative humidity of 10 percent. The densities of the films were measured after both 24 and 168 hours in the oven, using a MacBeth Model TD 504-A Densitometer with a green standard densitometer filter. The results are reported below.

| Coating Solution No. | Background Density After 24 Hours | Background Density After 168 Hours |
|---|---|---|
| 1 | 1.56 | 1.87 |
| 2 | 0.74 | 1.25 |
| 3 | 0.41 | 1.03 |
| 4 | 0.10 | 0.35 |
| 5 | 0.08 | 0.27 |

-continued

| Coating Solution No. | Background Density After 24 Hours | Background Density After 168 Hours |
|---|---|---|
| 6 | 0.09 | 0.33 |

For purposes of this example films with a density of greater than 0.08 are considered failures. The film coated with coating solution No. 1, having no phenidone, no 2,3-diaminonaphthalene, and no o-aminophenol present, failed upon drying. The films coated with coating solutions Nos. 2 and 3, containing either 2,3-diaminonaphthalene or o-aminophenol respectively as stabilizers, had a density far beyond the point of failure in less than 24 hours. The film carrying coating solution No. 4, containing phenidone alone as the stabilizer, had a background density of 0.10 after 24 hours, indicating that the film had just exceeded the point of failure.

Improved results are obtained from the use of combinations of phenidone and 2,3-diaminonaphthalene, or phenidone and o-aminophenol, as indicated by the density readings for films coated with coating solutions Nos. 5 and 6. In fact, combinations of phenidone and 2,3-diaminonaphthalene, or phenidone and o-aminophenol produce synergistic results, not anticipated by the results achieved with phenidone, 2,3-diaminonaphthalene, or o-aminophenol alone. The use of $0.8\times10^{-4}$ moles of 2,3-diaminonaphthalene (coating solution No. 2) results in a film having a density of 0.74 after 24 hours, and 1.25 after 168 hours. The use of $0.8\times10^{-4}$ moles of phenidone (coating solution No. 4) results in a film having a density of 0.10 after 24 hours, and 0.35 after 168 hours. If the effects of 2,3-diaminonaphthalene and phenidone were merely additive one would expect that Coating Solution No. 5 containing $0.4\times10^{-4}$ moles of 2,3-diaminonaphthalene and $0.4\times10^{-4}$ moles of phenidone, would result in a film having a density after 24 hours of somewhere between 0.74 and 0.1, and a density after 168 hours of somewhere between 1.25 and 0.35. However, the result of using Coating Solution No. 5 results in a film which has a density of 0.08 after 24 hours, and 0.27 after 168 hours, values which are below the lowest expected densities. These results evidence a synergistic stabilizing effect produced by the combination of phenidone and 2,3-diaminonaphthalene.

Likewise, the use of $0.8\times10^{-4}$ moles of o-aminophenol (Coating Solution No. 3) results in a film having a density of 0.41 after 24 hours, and 1.03 units after 168 hours. Again, the use of $0.8\times10^{-4}$ moles of phenidone (Coating Solution No. 4) results in a film with a density of 0.10 after 24 hours, and 0.35 after 168 hours. Thus, if the effects of phenidone and o-aminophenol were merely additive one would expect that a coating solution containing $0.4\times10^{-4}$ moles of phenidone and $0.4\times10^{-4}$ moles of o-aminophenol would result in a film having a density of somewhere between 0.41 and 0.10 after 24 hours, and a density somewhere between 1.03 and 0.35 after 168 hours. However, this combination of phenidone and o-aminophenol (Coating Solution No. 6) produces a film having a density of 0.09 after 24 hours and 0.33 after 168 hours. These values are below what would be expected and evidence a synergistic stabilizing effect produced by the use of combinations of phenidone and o-aminophenol.

EXAMPLE 12

Eleven coating solutions were prepared from 0.058 grams of the reduced and benzoylated form of N,N-diethylphenosafranine, 0.050 grams of the reduced and benzoylated form of Safranine O, 0.023 grams of 3,7-bis(diethylamino)-10-benzoylphenoxazine, 4 grams THF, 0.06 grams phthalic acid, 0.12 grams nickel nitrate dihydrate, 8 grams of a 15 percent by weight solution of vinylidene chloride copolymerized with acrylonitrile ("Saran F-310") in methylethyl ketone, and the following amounts of catechol and phenidone derivatives.

| Coating Solution No. | Moles Catechol | Moles Phenidone Derivative | Time to Failure (in hours) |
|---|---|---|---|
| 1 | $1.2 \times 10^{-4}$ | 0.0 | 290 |
| 2 | 0.0 | $1.2 \times 10^{-4}$[1] | 22 |
| 3 | $0.6 \times 10^{-4}$ | $0.6 \times 10^{-4}$[1] | >1363 |
| 4 | 0.0 | $1.2 \times 10^{-4}$[2] | 30 |
| 5 | $0.6 \times 10^{-4}$ | $0.6 \times 10^{-4}$[2] | >1363 |
| 6 | 0.0 | $1.2 \times 10^{-4}$[3] | 46 |
| 7 | $0.6 \times 10^{-4}$ | $0.6 \times 10^{-4}$[3] | 1363 |
| 8 | 0.0 | $1.2 \times 10^{-4}$[4] | 30 |
| 9 | $0.6 \times 10^{-4}$ | $0.5 \times 10^{-4}$[4] | >1363 |
| 10 | 0.0 | $1.2 \times 10^{-4}$[5] | 46 |
| 11 | $0.6 \times 10^{-4}$ | $0.6 \times 10^{-4}$[5] | >1363 |

Figure 2:
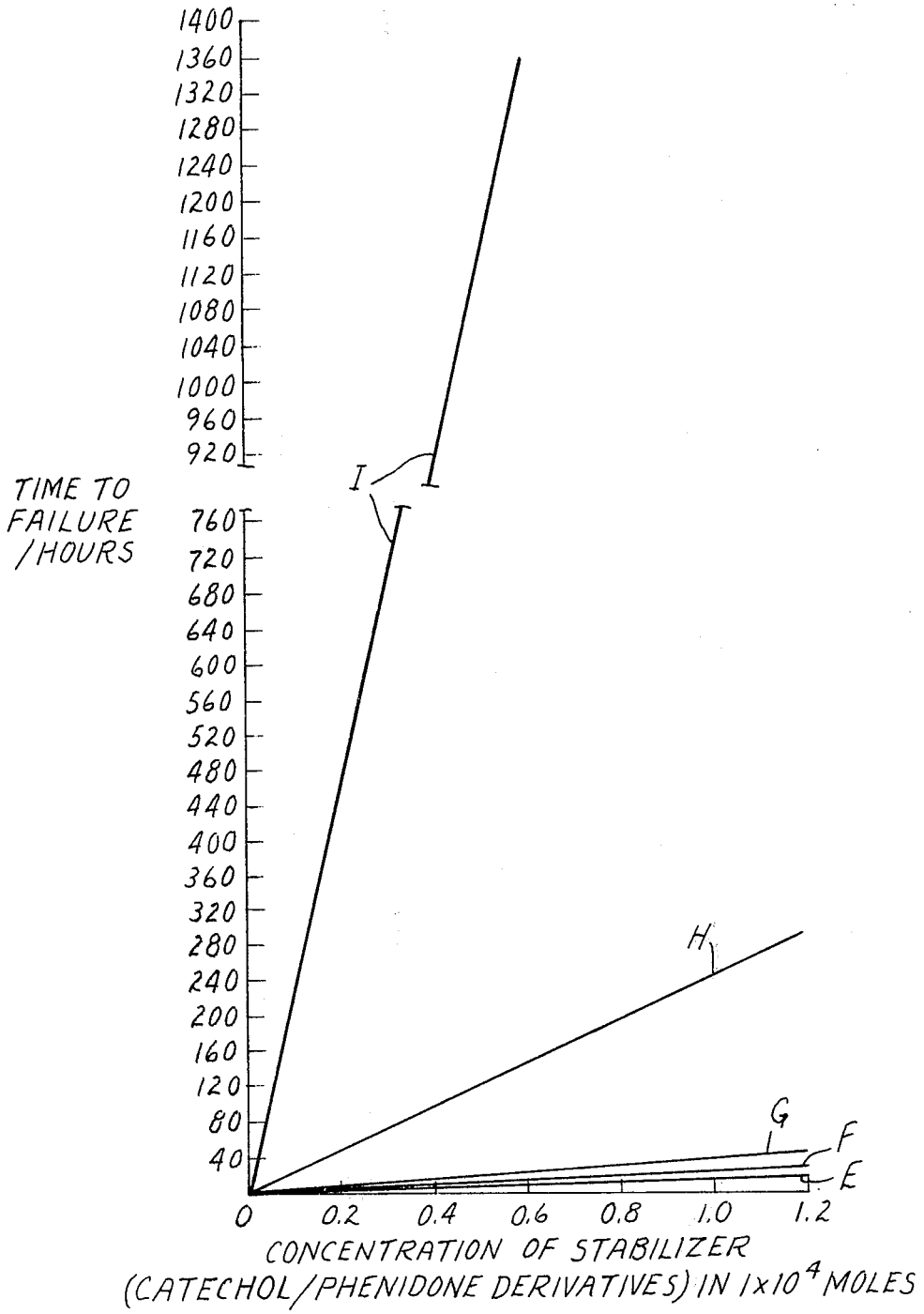

[1]The phenidone derivative is 1-p-anisyl pyrazolidin-3-one
[2]The phenidone derivative is 1-p-chlorophenol pyrazolidine-3-one
[3]The phenidone derivative is 1-m-chlorophenol pyrazolidin-3-one
[4]The phenidone derivative is 1-p-tolyl pyrazolidin-3-one
[5]The phenidone derivative is 1-p-fluorophenyl pyrazolidin-3-one The above coating solutions were coated on clear polyester film, dried, and stored overnight, as in Example 10. The following day the samples were separated using paper slip sheets, placed in a manila folder, and then placed in an oven at 49° C. and 10 percent relative humidity until failure. Failure was defined as the time at which the density of the film reached 0.09 density units, measured on a MacBeth TD-504-A Densitometer, or when the film became visibly spotted. The hours to failure are shown above. Concentration of stabilizer, (concentration of phenidone derivative or catechol) versus time to failure is plotted in FIG. 2. Curve E represents coating solution No. 6, containing a phenidone derivative but no catechol. Curve F represents coating solution Nos. 4 and 10, each containing a phenidone derivative but no catechol. Curve G represents Coating Solution Nos. 2 and 8, each containing a phenidone derivative but no catechol. Curve H represents Coating Solution No. 1, containing catechol but no phenidone or phenidone derivative. Curve I represents Coating Solution No. 7 containing catechol plus a phenidone derivative. Results for the other coating solutions containing combinations of catechol and phenidone derivatives (Coating Solution Nos. 3, 5, 9, and 11) do not appear in FIG. 2 since these have not failed even after 1,363 hours. FIG. 2 illustrates that the combination of catechol and phenidone derivatives produces a synergistic stabilizing effect which is greater than the result expected from the stabilizing effect of catechol and phenidone derivatives alone.

What is claimed is:

1. In a thermally developable imaging material, an imageable layer comprising a polymeric binder, at least one leuco dye, and nitrate salt, said nitrate salt having a cation which is nonreactive with said leuco dye and said nitrate salt capable of liberating an oxidizing amount of $HNO_3$ or oxides of nitrogen when heated to a temperature of no more than 200° C. for 60 seconds, wherein the improvement comprises the presence of a stabilizing combination, said combination comprising (1) an aromatic compound having at least two substituents selected from the group consisting of amino and hydroxy substituents, wherein said polyhydroxy aromatic compounds form quinones upon oxidation, said polyamino aromatic compounds form diimines upon oxidation, and said aromatic compounds having amino and hydroxy substituents form quinonimines upon oxidation, and (2) 1-phenyl-3-pyrazolidinone, or derivatives of 1-phenyl-3-pyrazolidinone having the general formula

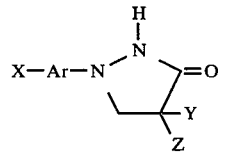

wherein

Ar is selected from the group consisting of phenyl and naphthyl groups;

X is selected from the group consisting of an aryl group, and alkyl group, straight or branched chain, having from about 1 to 5 carbon atoms, an alkoxy group, straight on branched chain, having from about 1 to 5 carbon atoms, H, F, Cl, Br and I; and Y and Z are independently selected from the group consisting of H and alkyl groups, straight or branched chain, having about 1 to 5 carbon atoms, said stabilizing combination being present in an amount sufficient to promote a synergistic stabilizing effect in said thermally developable imaging material.

2. In a thermally developable imaging material, the imageable layer of claim 1 wherein said aromatic compound has a benzene nucleus, and wherein at least two of said substituents on said benzene nucleus are ortho and para and said two substituents are coplanar with said benzene nucleus.

3. In a thermally developable imaging material, the imageable layer of claim 1 wherein said aromatic compound has a naphthalene nucleus, and wherein at least two substituents on said naphthalene nucleus are in positions selected from the group consisting of the 1 and 2; 2 and 3; 1 and 4; 1 and 7; and 2 and 6 positions, and wherein said two substituents are coplanar with said naphthalene nucleus.

4. In a thermally developable imaging material, the imageable layer of claim 1 wherein said aromatic compound is selected from the group consisting of catechol; hydroquinone; 2-t-butylhydroquinone; 1,2,3-trihydroxybenzene; 1,2,4-trihydroxybenzene; o-aminophenol; p-aminophenol; 1,7-dihydroxynaphthalene; trimethylhydroquinone; 2,5-di-t-butylhydroquinone; 3,5-di-isopropylcatechol; 4-(2-aminoethyl)-2-hydroxyphenol.HCl; 2,3-dihydroxynaphthalene; 2,6-dihydroxynaphthalene; 4-amino-1-naphthol.HCl; 2-amino-4-chlorophenol; 4-amino-3-methylphenol; 4-amino-2,6-dibromophenol; p-phenylenediamine; o-phenylenediamine; 2,3-diaminonaphthalene; and 2,4-diaminophenol.2HCl.

5. In a thermally developable imaging material, the imageable layer of claim 1 wherein said 1-phenyl-3-pyrazolidinone or said derivative of 1-phenyl-3-pyrazolidinone is selected from the group consisting of 1-p-anisyl pyrazolidin-3-one, 1-p-chlorophenyl pyrazolidin-3-one, 1-m-chlorophenyl pyrazolidin-3-one, 1-p-tolyl pyrazolidin-3-one, and 1-p-fluorophenyl pyrazolidin-3-one.

6. In a thermally developable imaging material, the imageable layer of claim 1 wherein said stabilizing combination is present in a concentration of at least 0.08 mole of stabilizing combination per mole of said leuco dye.

7. In a thermally developable imaging material, the imageable layer of claim 1 wherein the ratio of said 1-phenyl-3-pyrazolidinone or said derivative of 1-phenyl-3-pyrazolidinone to said aromatic compound is between about 0.7 to 1 and 3 to 1.

8. In a thermally developable imaging material, the imageable layer of claim 1 wherein said leuco dyes are selected from the group consisting of triphenylmethane dyes, triarylmethane dyes, styryl dyes, N-acyl thiazine dyes, N-acyl oxazine dyes, cyanine dyes, N-acyl diazine dyes and xanthene dyes.

9. In a thermally developable imaging material, the imageable layer of claim 1 wherein said leuco dye is present as at least 0.5 percent by weight of said binder, and the nitrate ion is present in a ratio to said combination of leuco dyes, of at least 0.02 mole nitrate ion per mole leuco dye.

10. In a thermally developable imaging material, the imageable layer of claim 1 wherein said nitrate salt is present as a metal nitrate salt.

11. In a thermally developable imaging material, the imageable layer of claim 1 wherein said nitrate salt is present as a hydrated metal nitrate salt.

12. In a thermally developable imaging material, the imageable layer of claim 11 wherein said hydrated metal salt is selected from the class consisting of hydrated salts of zinc, cadmium, calcium, zirconyl, nickel, aluminum, chromium, iron (III), copper (II), magnesium, lead, cobalt, beryllium, cerous, lanthanum, marganous, mercurous, uranyl and thorium.

* * * * *